United States Patent [19]

Laipply

[11] Patent Number: 4,991,985

[45] Date of Patent: Feb. 12, 1991

[54] MULTIFUNCTIONAL HANDLE FOR WRITING IMPLEMENT

[76] Inventor: Thomas C. Laipply, 28 Lyman Cir., Shaker Heights, Ohio 44122

[21] Appl. No.: 290,143

[22] Filed: Dec. 27, 1988

[51] Int. Cl.[5] ..... A46B 5/02

[52] U.S. Cl. ..... 401/6; 401/48; 401/117; 401/114; 24/11 CT; 15/425

[58] Field of Search ..... 401/6, 48, 117, 7, 8; 24/11 HC, 11 CC, 11 R, 11 CT, 11 S, 11 F; 15/425–428, 430, 437, 443

[56] References Cited

U.S. PATENT DOCUMENTS

| | | | |
|---|---|---|---|
| 249,893 | 11/1881 | Bulkeley . | |
| 629,436 | 7/1899 | Faust . | |
| 794,329 | 7/1905 | Whitehouse . | |
| 1,291,972 | 1/1919 | McGuigan . | |
| 1,419,257 | 6/1922 | Harrigan | 22/11 CT |
| 1,763,327 | 6/1930 | Richie | 401/6 |
| 2,114,203 | 4/1936 | Agbayani | 401/117 |
| 2,435,185 | 1/1948 | Reynolds | 401/117 |
| 2,845,047 | 7/1958 | McKendree | 401/6 |
| 3,740,159 | 6/1973 | Smagala-Romanoff | 401/117 |
| 3,741,665 | 6/1973 | Smagala-Romanoff . | |
| 4,167,347 | 9/1979 | Hoyle . | |

*Primary Examiner*—Richard J. Apley
*Assistant Examiner*—D. F. Crosby
*Attorney, Agent, or Firm*—D. Peter Hochberg; Mark Kusner; Louis J. Weisz

[57] ABSTRACT

A grip-steadying device for a writing instrument with an elevated-elongate grip-protrusion extending from the barrel of the instrument. The protrusion may extend from, or comprise a collar adapted to slidably encircle the barrel that can be moved to a point convenient to the grip of the user, or be positioned over the writing tip of the instrument when the latter is not in use. If desired, a holding clip can be provided in association with the collar.

6 Claims, 2 Drawing Sheets

MULTIFUNCTIONAL HANDLE FOR WRITING IMPLEMENT

FIELD OF THE INVENTION

This invention relates to writing implements and to their use. More particulary, this invention relates to hand-held writing instruments fitted with grip-steadying devices which enhance control of the instruments by users thereof. Specifically, this invention relates to grip-steadying devices comprising elevated-elongate protrusions extending outwardly along the longitudinal axis of hand-held writing instruments, and to variations thereof, which allow the instruments to be more precisely manipulated by users.

BACKGROUND OF THE INVENTION

There are few things more basic to civilization than the process of inscribing thoughts and other expressions of intelligence on paper and similar materials with writing instruments such as pencils, pens, and similar implements. For individuals to write successfully, however, requires a high order of hand-eye coordination, as well as the ability to impose relatively subtle movements on the writing instrument; otherwise, the writing is difficult or impossible for individuals to read, sometimes including the writer thereof. While writing is taught to most individuals at an early age, many have difficulty mastering the manual dexterity required for proper guidance of a pen or pencil. In addition, some individuals are handicapped by physical limitations, disease, advanced age, or from other causes, and these find writing a difficult task to carry out competently. Furthermore, in many instances, the configuration of the writing instruments themselves are of small diameter, or otherwise difficult to grasp securely, making their accurate movement difficult, even by those skilled in the art of writing.

In addition, in the case of some writing instruments such as, for example, pens, it is frequently necessary or desirable to protect the instrument's point, either from damage, or from soiling items with which it comes in contact.

Various devices have been proposed ot facilitate the writing task, for example, a finger rest for pencils and penholders is disclosed in U.S. Pat. No. 249,893; a hand-positioning attachment for a pen in shown in U.S. Pat. No. 629,436; an expansible elastic grip for pencils and penholders is taught in U.S. Pat. No. 1,291,972; finger grip and cushion attachments are shown, respectively, in U.S. Pat. No. 2,173,451 and U.S. Pat. No. 2,236,194; a removable finger grip adaptable to different sized writing instruments is described in U.S. Pat. No. 4,167,347; and a device for ading in the gripping of writing instruments is illustrated in U.S. Pat. No. 4,526,547.

While each of the devices mentioned is designed to assist in the writing process, the devices have significantly different structures than the invention taught herein, and such devices are believed to be substantially less effective in achieving the stabilizing effect which the invention herein disclosed seeks to achieve. Furthermore, none features an ability to protect the point of a writing instrument from damage.

DISCLOSURE OF THE INVENTION

In view of the preceding, therefore, it is a first aspect of this invention to provide a device for steadying a user's grip on, and for stabilizing the manipulation of writing implements.

A second aspect of this invention is to furnish a grip-steadying device which facilitates the use of writing instruments, not only by normal individuals, but by those suffering from an infirmity which interferes with their writing ability.

Still a futher aspect of this invention is to provide a grip-steadying device for a writing instrument that has multifunctional features which include provision of point protection for the instrument with which it is used, which also include provision of a grip-steadying handle as a part thereof, and which provide an attachment clip adapted to secure the instrument to a user's clothing when the instrument is not in use.

An additional aspect of this invention is to provide a grip-steadying device which may be variably positioned, depending upon the preference of the user.

Another aspect of this invention is the provision of a grip-steadying device for a writing instrument which can be moved to a position providing protection for the writing tip of the instrument, when the instrument is not being used.

A further aspect of this invention is to furnished a grip-steadying device for a writing instrument which allows the device, and therefore, the instrument of which it forms a part, to be attached to the clothing of a user, when not in use.

A still additional aspect of this invention is to provide a grip-steadying device comprising a collar structure that encircles a writing instrument and furnishes a smooth-surfaced interface which enables the collar to be easily moved along the instrument to any point desired.

A still further aspect of this invention is to provide a flexible grip-steadying device that is adapted to fit writing instruments of differing diameters.

The foregoing and other aspects of the invention are achieved by a hand-held writing instrument, in combination with a grip-steadying device, said grip-steadying device comprising an elevated-elongate protrusion adjacent the exterior surface of said instrument, parallel to its longitudinal axis.

The foregoing and additional aspect of the invention are achieved by a grip-steadying device for a hand-held writing instrument, said grip-steadying device comprising an elevated-elongate protrusion in the form of a cylindrical collar, said collar being adapted to encircle said instrument, in contact therewith, and to be slidably moveable along an interface between said collar and said instrument.

The foregoing and still additional aspects of the invention are provided by a grip-steadying device for a hand-held writing instrument, said grip-steadying device comprising a cylindrical collar adapted to encircle at least a portion of said instrument in contact therewith and slidably movable therealong, wherein said collar has a cantilevered clip projection attached thereto and extendding therefrom, said projection extending parallel to the longitudinal axis of said collar and spaced from said collar or a line of extension therefrom.

BRIEF DESCRIPTION OF THE DRAWINGS

The invention will be better understood when reference is had to the following figures, in which like-numbers refer to like-parts, and in which.

DETAILED DESCRIPTION OF THE INVENTION

Figure 1:
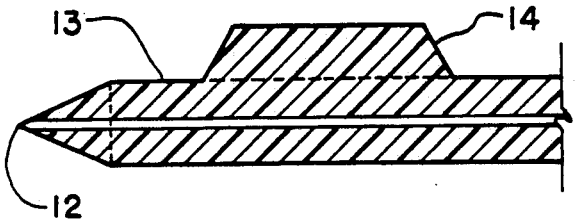
FIG. 1 is a cross-sectioned side elevation of a writing instrument showing a grip-steadying device of the invention, integral with the instrument.

FIG. 1 is a cross-sectioned side elevation of a writing instrumet, generally 13, showing a grip-steadying devivce of the invention, integral with the instrument. In the Figure, a ridge-like, elevated-elongate grip-steadying protrusion 14 is integrally attached to the writing implement, or instrument, substantially adjacent to the writing tip 12 of the instrument. Such integral attachment can be achieved by forming the protrusion and the writing instrument separately and thereafter securing them together by means of an adhesive, or in equivalent ways, or by forming the combined structure together initially, as for example, when both the elevated-elongate protrusion and the instrument and molded from plastic simultaneously.

As previously described, writing instruments frequently have a relatively small diamter, making them difficult to grasp securely. The elevated-elongate protrusion 14 provides support for the thumb and forefinger, thereby enabling a firmer, steadier grasp of the instrument to be achieved. While it is important that the longitudinal shape be appreciably elevated and elongated, and contain no sharp edges or angles in contact with the writer's fingers so that it may be easily grasped between the thumb and foregfinger of the writer's hand at varying locations, the cross-sectional shape of the protrusion 14 is relatively unimportant in that the cross-sectional shape, for instance, may be wedge-like, rectangular, rounded, or it may be configured in some other elevated and elongated shape, for example, such as a thickened collar adapted to be comfortably, yet firmly grasped. Futhermore, while the sides of the elevated-elongate protrusion may be smooth, when they are provided with a roughened texture, they facilitate grasp by the user, and are, therefore, easier to use. The elvated-elongate protrusions may be made from any of a variety of materials, for example, wood, metal, plastic, and the like, the use of plastic frequently being conveient, since it can easily be formed into a variety of shapes, and is inexpensive to process. Any of various plastics such as PVC, polyolefins, and others, may all be readily used for the purpose.

While FIG. 1 illustrates a single elevated-elongate protrusion 14, more than one such protrusion may be positioned near the tip of the instrument, providing the user with a gripping option, sometimes desirable, for example, when particularly fine work is being attempted, as opposed to coarser movements.

While the invention may be used in connection with a variety of hand-held writing instruments such as ball point pens, fountain pens, pencils, crayons, and like instruments, it is particularly useful in connectin with ball point pens.

Figure 2A:
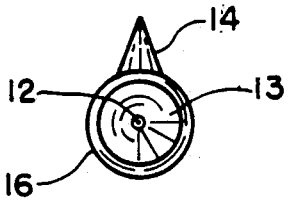
FIG. 2A shows an end elevation of the device of FIG. 2.
Figure 2:
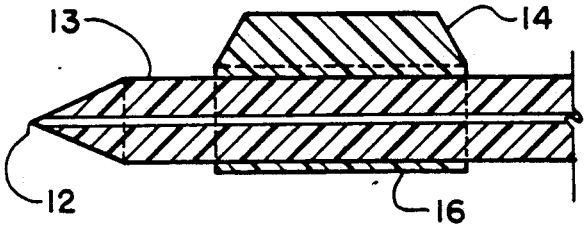
FIG. 2 is a cross-sectioned side elevation of a writing instrument showing a further embodiment of the invention which includes a grip-steadying device separate from the instrument.

FIG. 2 shows a cross-sectioned side elevatin of a writing instrument, illustrating a further embodiment of the invention comprising a grip-steadying device separate from the writing instrument. As shown, the elevated-elongate protrusion 14 is attached to a collar 16, the collar and the elevated-elongate protrusion, advantageously, forming a single structure, although they may be formed separately and subsequently connected. The collar 16 is slidably mounted on the writing instrument pen, as has the advantage of being adjustable along the entire length of the writing instrument to whatever position is most comfortable for the user for the task being attempted. The collar 16 is typically shaped to conform substantially to the transverse cross-section of the writing instrument. In the case of the writing instrument 13, shown as round in all the figures, the collar is adjustable about both axes of the writing instrument, i.e., it can be rotated about the transverse axis of the writing instrument, as well as moved back and forth along its longitudinal axis. While the "fit" between the collar 16 and the instrument 13 is sufficiently snug so that the collar will not be prone to movement during the writing process, given the coefficient of friction exiting between the collar and the writing instrument, the collar-type elevated-elongate protrusion lends itself to adjustment with only one hand, although two are sometimes used if fine adjustment is requied, or if the fit between the components is particularly tight. Both the collar wall and its end edges cooperate to make adjustments easy to accomplish. Although the simplicity of design and ability of collar 16 to slide smoothly along the entire length of the writing instrument 13 are features which made the embodiment illustrated in FIG. 2 particularly preferred, if desired, blister-like protrusions or equivalent collar-stopping structure of the type well-known in the art may be employed to limit travel of the collar along the barrel of the instrument.

FIG. 2A shows an end elevation of the device of FIG. 2. A writing instrument 13 with writing tip 12 is shown, encircled by collar 16, with a grip-steadying, elevated-elongate protrusion 14 extending therefrom.

While the protrusion 14 is shown in the Figure as having a wedge-like cross-section, as previously indicated, its shape may be suitably modified.

Figure 3:
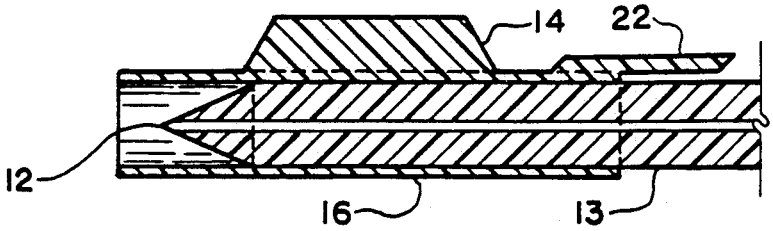
FIG. 3 shows a side elevation of a grip-steadying device of the invention also adapted to serve as a protective writing tip shroud.

FIG. 3 shows a side elevation of a grip-steadying device of the invention, which is also adapted to serve as a protective writing tip shroud. As shown in the Figure, collar 16, with the elevated-elongate protrusion 14 forming a part thereof, has been slid forward on the writing instrument 13 so that it forms a protective shroud about writing tip 12. The use of the collar 16 to protect writing point 12 has the advantage of making an overall shorter writing instrument possible, since it is unnecessary to provide a separate point protector which must be repositioned to the opposite end of the writing instrument when the latter is being used. A further advantage lies in the fact that the end opposite the writing tip of the instrument can be shaped in any fashion desired, inasmuch as it is unnecessary to have both ends of the instrument shaped to receive the same protective cap.

Considerable latitude may be exercised in forming the grip-steadying elevated-elongate protrusion 14; for example, it can be uniform in shape, from one end to the other, or it may vary either abruptly, or gradually. However, in addition to being substantially elongated, it must be high enough to permit it to be easily grasped by the thumb and forefinger of the writer's hand. Likewise, the dimensions of the collar and its associated protrusion, or either, can be varied within a reasonably broad range while still accomplishing the function intended. However, in a preferred embodiment of the invention, the elevated-elongate protrusion 14 will be from about $\frac{1}{4}$ inch to about 2 $\frac{1}{2}$ inches long, and from about 1/16 inch to about $\frac{1}{4}$ inch high.

Figure 4:
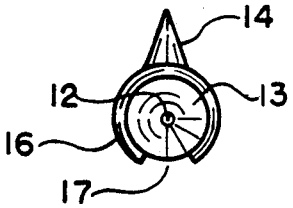
FIG. 4 shows an end elevation of the device of FIG. 2, modified to include a split collar.

FIG. 4 shows an end elevation of the device of FIG. 2, modified to include a split collar. As shown, a writing instrument 13 having a writing tip 12 disposed on the end thereof, is encircled by a collar 16 having an elevated-elongate protrusion 14 extending therefrom. The collar is split along its longitudinal axis, on the bottom portion thereof, providing a gap 17 in the collar. When a split collar embodiment is employed, the collar is desirably formed from a flexible, resilient material, making it easier for the grip-steadying assembly to be transferred from one writing instrument to another. In addition, it serves to allow the collar to be shifted along the longitudinal axis of a writing instrument more easily.

Figure 5:
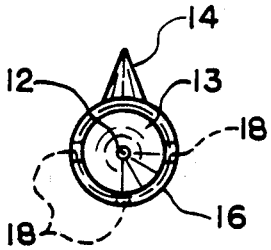
FIG. 5 illustrates and end elevation of the device of FIG. 2 modified to include a collar with longitudinal slits.

FIG. 5 illustrates an end elevation of the device of FIG. 2, modified to include a collar with longitudinal slits therein. Illustrated in the Figure is a writing instrument 13 with a writing tip 12, the instrument being encircled by a collar 16 with an elevated-elongate protrusion 14 positioned on the top thereof. As shown, a series of longitudinal slits 18 is provided in the collar, at both the sides and botton thereof. The slits provide additional flexibility to the collar, allowing it to be slidably positioned more easily.

Figure 6:
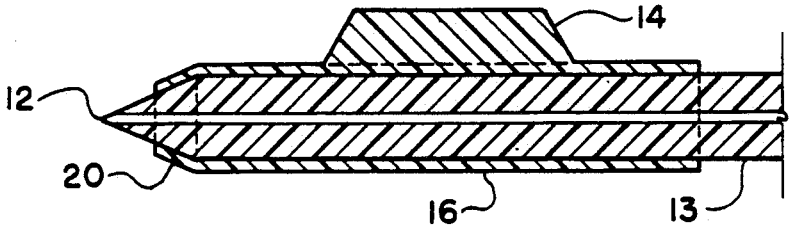
FIG. 6 illustrates a cross-sectioned side elevation of a writing instrument with a grip-steadying device of the invention which includes a collar having a tapered end.

FIG. 6 illustrates a cross-sectioned side elevation of the writing instrument with a grip-steadying device of the invention that includes a collar with a tapered end thereon. A collar 16 having a tapered end 20 and an elevated-elongate protrusion 14 extending therefrom is positioned about the writing instrument 13, the tapered end partially covering the writing tip 12. The tapered end 20 limits the movement of the elevated-elongate protrusion 14 rearward, away from the writing tip 12, serving to automatically position the protrusion at a pre-determined, convenient point. As in the case of the embodiment of FIG. 3, the collar 16 may be slid forward, toward the writing tip, providing a protective shroud about the tip.

In any of the embodiments of the invention including a slidable collar, one or both terminal edges of the collar may be fabricated with a thicker edge than the rest of the collar to facilitate its positioning as previously described. Also, and if desired, the inner surface of the collar may be polished, or it may be textured so that contact between the collar and the writing instrument only occurs at a limited number of points, thus further facilitating sliding adjustment of the collar. However, a feature of the invention is that the interface between the inner surface of collar 16 and the outer surface of the instrument 13 is smooth. That is, it has no annular grooves, or equivalent surface irregularities that would prevent the device form exhibiting the smooth interface necessary to permit easy sliding of the collar to any writing position desired. The sliding action of collar 16 along the barrel of the instrument 13 may be further enhanced and made even smoother through provision of one or more raised surface features such as projections or elevations, for example, longitudinal or circular ridges on the interior surface of the collar. In a preferred embodiment, such features will be flexible, allowing transfer of the collar between instruments of differing diameter.

The materials from which the collar and writing instruments are made may be the same or different, as desired; however, the use of the same material often provides certain manufacturing economies, as well as advantageous frictional characteristics, and the use of identical materials is, therefore, often preferred. Even apart from the split collar embodiment of the invention, the use of collars formed from relatively flexible materials is desirable since it not only facilitates the transfer of the collars between writing instruments having differing diameters, but allows compression of the collars against the instruments when they are gripped, providing a more secure grasp.

Figure 7:
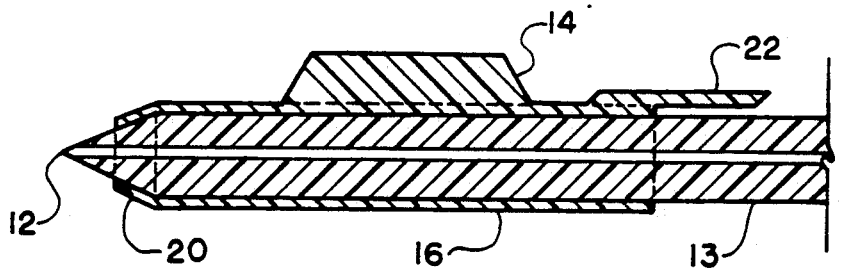
FIG. 7 is a cross-sectioned side elevation of a writing instrument with a tapered, grip-steadying device of the invention which also includes a hoding clip.

FIG. 7 is a cross-sectioned side elevation of a writing instrument fitted with a tapered grip-steadying device of the invention which includes a clip arrangement. As shown, a collar 16 with a tapered end 20 is positioned about the barrel of a writing instrument 13, and partially about its tip end 12. An elevated-elongate protrusion 14 is located on the collar, and extending from the rearward end, or end opposite the writing tip 12, is a cantilevered clip porjectin 22 positioned parallel to the longitudinal axis of the instrument and spaced apart from tbe writing instrument in order to admit a layer of fabric, as for instance, the fabric forming the edge of a user's pocket. As in the case of the protrusion itself, the outer surfce of the clip may be roughened by the provision of raised or depressed areas, making it easier to grip and adjust the collar to the position desired.

Although the clip 22 and elevated-elongate protrusion 14 are commonly quite similar in construction, for example, height from the collar, cross-sectional shape, and so forth, they may have different heights or shapes if desired.

Figure 8:
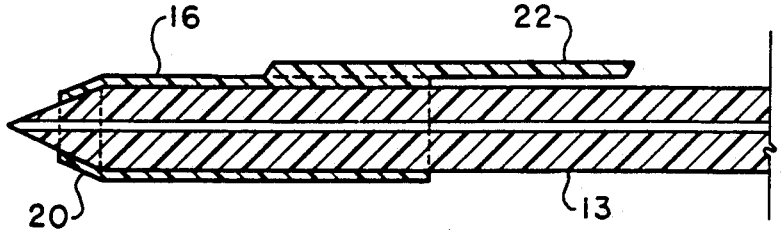
FIG. 8 shows a cross-sectioned side elevation of a writing instrument with a collar having a tapered end that includes a holding clip configured to also serve as a grip-steadying device.

FIG. 8 shows a cross-sectioned side elevation of a writing instrument with a collar having a tapered end that includes a holding clip configured to serve as a grip-steadying device. As illustrated, the grip-steadying device includes a collar 16 with a tapered end 20 encircling a writing instrument 13. In the embodiment shown, a cantilevered clip projection 22 is fastened to the collar, serving both as an elevated-elongate protrusion, as well as a way in which to fasten the collar, and therefore the writing instrument to a user's clothing, when the instrument is not in use.

Figure 9:
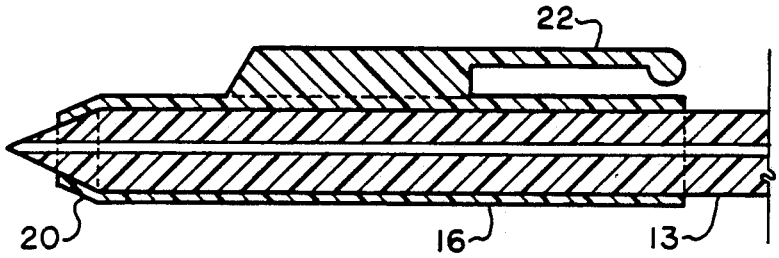
FIG. 9 is a cross-sectioned side elecation of a further embodiment of a writing instrument with a tapered end collar equipped with a holding clip designed to serve as a grip-steadying device.

A variation of the embodiment depicted in FIG. 8 is shown in FIG. 9, which is a cross-sectioned side elevation of a preferred embodiment of a writing instrument 13 having a tapered end collar equipped with a holding clip designed to serve as a grip-steadying device. In FIG. 9, the clip projection 22 has a forward end integral therewith which is somewhat elevated as compared to the forward end of the clip projection in FIG. 8, permitting the cantilevered portion to be spaced apart from the collar 16, admitting the fabric to which the collar is clipped when not in use. Both embodiments shown in FIGS. 8 and 9 provide a more compact grip-steadying device and present a somewhat more pleasing appearance than the device shown in FIG. 7.

Figure 10:
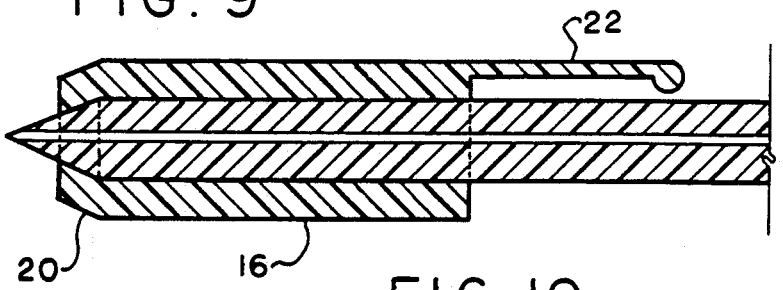
FIG. 10 illustrates another embodiment of a cross-sectioned side elevation of a still further embodiment of a writing instrument with a tapered end collar that serves as a grip-steadying device, also equipped with a holding clip.

FIG. 10 illustrates a cross-sectional side elevation of another embodiment of a writing instrument with a tapered end collar that functions as a grip-steadying device, which is also equipped with a holding clip. The essential difference between the emboidiment of FIG. 10 relative to the prior embodiments, is that FIG. 10 employs a collar portion 16 having a somewhat larger diameter than the collars illustrated in prior embodiments, allowing it to itself function as an elevated-elongate protrusion. In the Figure, the collar 16, equipped with a tapered end 20, has a cantilevered clip projection 22 extending from the end farthest from the tip end of the collar. While differently configured, the elevated-elongate thickened collar 16 functions in a manner similar to that of the embodiment of the elevated-elongate protrusion 14 of FIG. 7. When reliance is had upon a "thickened" collar for the grip-steadying function of the devices of the invention, the wall thickness of the collar should normally be from about 1/32 inch to about 3/16 inch, although thicher wall sections may also be employed with the beneficial effects previously noted.

Figure 11:
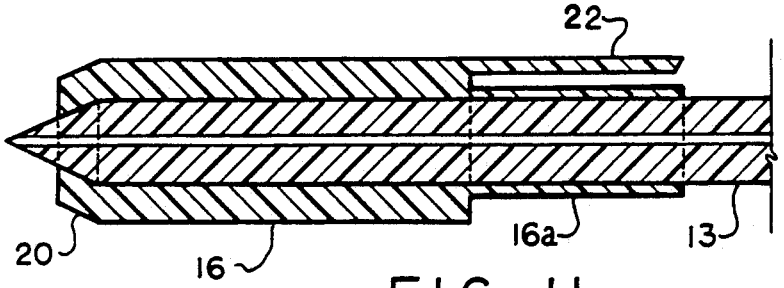
FIG. 11 illustrates a cross-sectioned side elevation of another embodiment of a writing insturment with a tapered end collar that functions as a grip-steadying device, and which is also equipped with a holding clip.

FIG. 11 illustrates an embodiment similar to that shwon in FIG. 10 except, however, that an unthickened portion of the collar **16*a* extends from the rear end of collar 16, co-extensive with the cantilevered clip 22. In the case of the Figure, the fabric holding space is located between the cantilevered clip and the collar extension, whereas in the embodiment of FIG. 10 the space is located between the cantilevered clip 22** and the barrel of the writing instrument.

With respect to all embodiments of the invention employing a slidable collar, the device of the invention is fabricated so that the degree of fit between the collar and the barrel of the writing instrument, as well as the coefficient of friction between those components, is such that the collar can be slidably moved along the longitudinal axis of the writing instrument, while still exhibiting stability in the position selected for writing.

In addition, and with respect to those embodiments of the invention which include a cantilevered clip projection, while the projection is commonly mounted near to, and extends from the rear end of the collar, it may be mounted at any place on the collar, including the end thereof located nearst the writing tip.

While in accordance with the patent statutes, a preferred embodiment and best mode has been presented, the scope of the invention is not limited thereto, but rather is measured by the scope of the attached claims.

What is claimed is:

1. A tubular grip steadying device for a hand held writing instrument comprising a circular cylindrical collar having a smooth inner cylindrical surface for encircling at least a portion of the transverse periphery of said instrument and slidably movable there along and said instrument being thereby positionable at an infinite number of locations along the entire instrument, said collar having a cylindrical exterior surface including an elevated, elongate protrusion extending outward from the exterior surface to a height sufficient to be graspable between opposing surfaces of a writer's thumb and forefinger and positioned parallel to the instrument's logitudinal axis wherein said collar is long enough to be slid toward the instrument's tip sufficiently far so that one of its end is substantially co-extensive with said tip, while the other end still encircles said instrument, and wherein said collar has a cantilevered clip projection attached thereto and extending parallel to the longitudinal axis of said instrument and being spaced therefrom so as to admit a layer of fabric to which said instrument can be clipped.

2. The combination of claim 1, wherein said instrument has a conical writing tip, and one end of said collar is conically tapered and adapted for positioning about a portion of said tip, and wherein said collar has a cantilevered clip projection attached thereto and extending therefrom parallel to the longitudinal axis of said collar.

3. The combination of claim 1 wherein said instrument has a conically tapered writing tip and one end of said collar has a substantially similar conical taper adapted for positioning about a portion of said tip.

4. The combination of claim 1 wherein said collar has at least one rige-like projection extending therefrom parallel to the longitudinal axis of said instrument, said projection adapted to be gripped by user's fingers.

5. The combination of claim 4 wherein said collar is split to provide a gap along its longitudinal axis.

6. The combination of claim 4, wherein said collar is provided with a plurality of slits parallel to its longitudinal axis.

* * * * *